US008819970B2

(12) United States Patent
Foster

(10) Patent No.: US 8,819,970 B2
(45) Date of Patent: Sep. 2, 2014

(54) MULTI-LAYERED ORNAMENTAL CLOTHING

(76) Inventor: Diana Foster, Potomac, MD (US)

( * ) Notice: Subject to any disclaimer, the term of this patent is extended or adjusted under 35 U.S.C. 154(b) by 0 days.

(21) Appl. No.: 13/566,272

(22) Filed: Aug. 3, 2012

(65) Prior Publication Data

US 2013/0031694 A1 Feb. 7, 2013

Related U.S. Application Data

(60) Provisional application No. 61/514,943, filed on Aug. 4, 2011.

(51) Int. Cl.

| | |
|---|---|
| ***G09F 21/02*** | (2006.01) |
| ***A41B 1/00*** | (2006.01) |
| ***A41D 27/08*** | (2006.01) |
| ***A41D 1/04*** | (2006.01) |

(52) U.S. Cl.

CPC . *A41D 1/04* (2013.01); *A41D 27/08* (2013.01)
USPC ..... 40/586; 2/244; 2/115; 2/69

(58) Field of Classification Search

USPC ..... 40/586; 2/244, 69, 115
See application file for complete search history.

(56) References Cited

U.S. PATENT DOCUMENTS 5,400,437 A * 3/1995 Koutras ..... 2/84
6,067,660 A * 5/2000 Contini ..... 2/246

* cited by examiner

*Primary Examiner* — Syed A Islam
(74) *Attorney, Agent, or Firm* — Robert M. Downey, P.A.

(57) ABSTRACT

A multi-layered-outfit 60 having one or more multi-layered-images 70 thereon consists of a base garment 20 having one or more base images 30 thereon and one or more complementary garments 40 having one or more enhancement-images 50 thereon. The base garment 20 may be made from any suitable clothing material. The complementary garment 40 must be made from a translucent or transparent clothing material in order to allow the base image 30 to be visible. Both the base garment 20 and the complementary garment 40 may be adapted to a variety of needs, such as lightweight fabric for warmer climates or a thicker fabric for colder climates. The base image 30 and the enhancement-image 50 are preferrably complementary images which combine when overlapped to form a more complete multi-layered-image 70.

2 Claims, 1 Drawing Sheet

MULTI-LAYERED ORNAMENTAL CLOTHING

BACKGROUND OF THE INVENTION

This non-provisional patent application is based on provisional application Ser. No. 61/514,943 filed on Aug. 4, 2011.

FIELD OF THE INVENTION

The present invention relates to articles of clothing that contain images thereon and that may be worn in overlapping combination to form a complementary multi-layered orientation of the images thereon.

DISCUSSION OF THE RELATED ART

Multi-layered clothing is a well-known and commonly-used choice for outfits because it provides advantages over using singular pieces of clothing. One advantage is an increased number of options for altering style by having the choice of color and design for multiple articles of clothing instead of only one (i.e. a person can combine a yellow shirt and a blue shirt, or a yellow shirt and a red shirt, instead of just being able to choose to wear one color). Another advantage is that different styles can be achieved that are either impossible or not preferable with one article of clothing, such as wearing a skin-tight undershirt and a looser over-shirt. Yet another advantage is that wearing multiple layers of clothing can provide additional comfort, particularly in colder climates.

However, despite the popularity of wearing multi-layered outfits, the ability for garments to complement each other when worn in a multi-layered fashion is heavily limited. In most cases, the details of any garments worn beneath the outer-most layer are almost entirely covered. As a result, the overall look and design of existing multi-layered outfits is almost entirely influenced by the look and design of the outer-most layer of clothing only.

In light of the shortcomings associated with the existing options for multi-layered clothing, there remains a need for a more effective combination of garments to provide a multi-layered-outfit that can be more customizable and that can display and combine more details of all of the garments in a complementary fashion.

SUMMARY OF THE INVENTION

The present invention is directed to a multi-layered-outfit having one or more multi-layered-images thereon. The multi-layered-outfit consists of a base garment having one or more base images thereon and one or more complementary garments having one or more enhancement-images thereon. The base garment may be made from any suitable clothing material. The complementary garment must be made from a translucent or transparent clothing material in order to allow the base image to be visible. Both the base garment and the complementary garment may be adapted to a variety of needs, such as lightweight fabric for warmer climates or a thicker fabric for colder climates. The base image and the enhancement-image are preferrably complementary images which combine when overlapped to form a more complete multi-layered-image.

OBJECTS AND ADVANTAGES OF THE INVENTION

Considering the foregoing, it is a primary object of the present invention to provide a multi-layered-outfit that has at least one multi-layered-image thereon.

It is still another object of the present invention to provide a multi-layered-outfit, as described above, which combines a base garment with one or more complementary garments in a multi-layered fashion.

It is still another object of the present invention to provide a multi-layered-outfit, as described above, which combines a base image with one or more complementary enhancement-images to form a more complete multi-layered-image.

It is still another object of the present invention to provide a multi-layered-outfit, as described above, that allows for a variety of combinations of garments and images so that any single garment or image is complemented by a large number of other garments and images, resulting in a large variety of outfit choices (e.g. a base garment having an image thereon of a person walking may be complemented by a variety of complementary garments having images thereon of various famous streets which the person could be shown walking on).

It is still another object of the present invention to provide a multi-layered-outfit, as described above, which allows for a variety of clothing material choices to meet the needs of any climate or style preferences, such as using a thick wool base garment or a transparent plastic complementary garment, as long as all complementary garments are translucent or transparent.

These and other objects and advantages of the present invention are more readily apparent with reference to the detailed description and accompanying drawings.

BRIEF DESCRIPTION OF THE SEVERAL VIEWS OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE INVENTION

Referring to the several views of the drawings, the present invention is shown and is generally indicated as 10.

Figure 1:
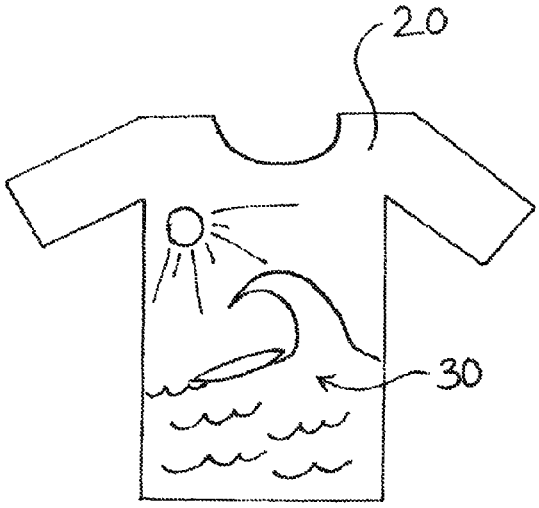
FIG. 1 is a frontal elevational view showing a base garment of the present invention.

Referring to FIG. 1, a base garment 20, also referred to as the primary garment 20, has at least one base image 30 thereon. The base garment 20 is not restricted in size, shape, or design, and may be manufactured from any suitable apparel material such as cloth (cotton, wool, silk, etc.), denim, fur or leather. The base image 30 thereon is hereinafter defined as any one or more shapes, patterns, colors, or text that contrast with the background color of the base garment 20 (therefore if the base garment 20 were to have three separate images, they would be herein defined collectively as base image 30).

Figure 2:
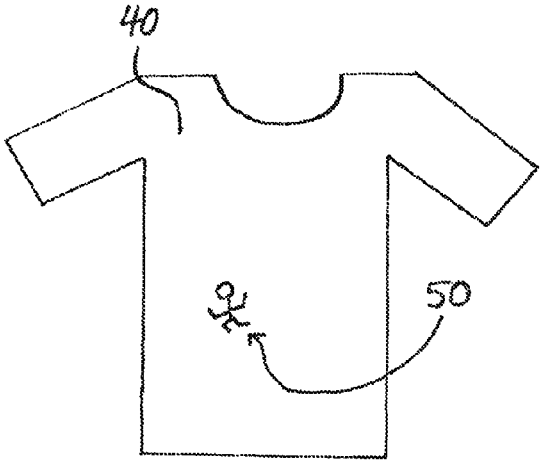
FIG. 2 is a frontal elevational view showing a complementary garment of the present invention.
Figure 3:
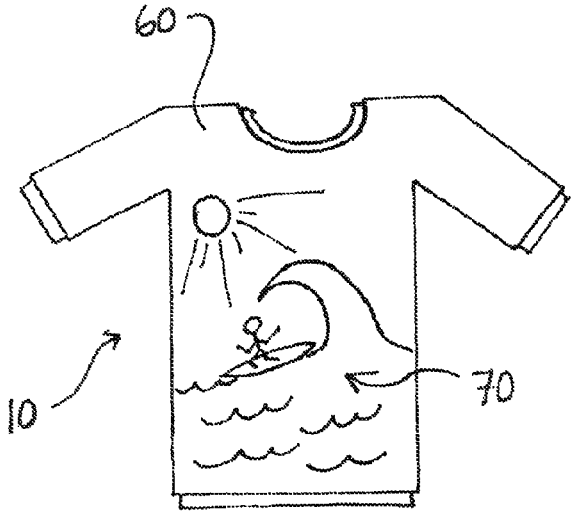
FIG. 3 is a frontal elevational view showing the complementary garment of FIG. 2 being worn over the base garment of FIG. 1 to produce a complementary orientation of the images thereon.

Referring to FIG. 2, a complementary garment 40, also referred to as the secondary garment 40, adapted to be worn over the base garment 20 depicted in FIG. 1 has at least one enhancement-image 50 thereon, wherein the enhancement-image 50 is complementary to the base image 30 depicted in FIG. 1 in such a way that when complementary garment 40 is worn over base garment 20 to form a multi-layered-outfit 60, portrayed in FIG. 3, a new multi-layered-image 70, also portrayed in FIG. 3, is formed. The complementary garment 40 may preferrably be at least somewhat of a looser fit than the base garment 20 for reasons of comfort and style. Complementary garment 40 must be manufactured from a material which is at least partially translucent or transparent in order to allow the base image 30 to be seen through the complementary garment 40. Materials suitable for the complementary garment 40 may include mesh, web and net fabric (fabrics with pieces woven together to leave a large number of closely-spaced holes), lace, sheer fabric (semi-transparent and flimsy cloth made from a very thin knit, the most prominent examples of which are gossamer, rayon and nylon) latex rubber or plastics (such as the clear plastic used in well-known complementary garments such as raincoats). It is noted herein that these materials suitable for complementary garment 40 may also be suitable for the base garment 20, should a person or manufacturer prefer the base garment 20 to be translucent or transparent (i.e. See-through clothing), however this is not required and exists only as an optional alternative to a more conventional choice of base garment 20 material such as cotton.

Referring to FIG. 3, the present invention 10 consists of the multi-layered-outfit 60 having a multi-layered-image 70 thereon. Multi-layered-outfit 60 results from a combination of the base garment 20, shown in FIG. 1, and the complementary garment 40, shown in FIG. 2. A combination of a base garment and a complementary garment 40 is well known in the art and is adaptable to a variety of situations, such as having a very lightweight complementary garment in warmer climates, or a heavier complementary garment in colder climates, and is generally considered to be a useful outfit combination because of the ability to combine the colors of the garments to achieve a more personalized style. The multi-layered-image 70 is formed as a result of the overlap of enhancement-image 50 onto base image 30, both of which are designed specifically to complement one another and to form a single, more complete image 70 upon overlapping.

The present invention 10 is not limited to a combination of a base garment 20 with only one complementary garment 40. The multi-layered-outfit 60 may optionally include a plurality of complementary garments 40, and therefore a plurality of enhancement-images 50, that combine with a base garment 20. Accordingly, the multi-layered-image 70 may be formed from one or more enhancement-images 50 and a base image 30. Any and all combinations of clothing materials (e.g. cotton, nylon, wool, etc.), sizes, articles (e.g. t-shirt, pants, long-sleeve shirts, etc.) and images are fully contemplated within the spirit and scope of the present invention (e.g. when a plurality of complementary garments 40 is used, it is possible for all complementary garments 40 to be made of the same material or it may alternatively be possible to have multiple complementary garments 40 made from multiple materials).

While the invention has been shown and described in accordance with several preferred and practical embodiments thereof, it is recognized that departures from the instant disclosure of the invention are fully contemplated within the spirit and scope of the invention and such changes, variations and modifications of the present invention are not to be limited except as recited in the following claims as interpreted under the Doctrine of Equivalents.

What is claimed is:

1. A method for creating enhanced ornamental images on a multi-layered clothing combination comprising the steps of:

providing a primary garment having at least one base graphic image thereon;

providing a secondary garment that is independent of and detached from the primary garment, and the secondary garment having at least one enhancement graphic image thereon and being adapted to fit over the primary garment, and the secondary garment being formed of a material that is structured and disposed to allow an image to be visible through the material;

providing a third garment that is independent of and detached from the primary garment and the secondary garment, and the third garment having at least one enhancement graphic image thereon that is different than the at least one enhancement graphic image on the secondary garment, and the third garment being adapted to fit over the primary garment and being formed of a material that is structured and disposed to allow an image to be visible through the material;

fitting the secondary garment over the primary garment to produce a first multi-layered combinatory image, wherein the at least one enhancement graphic image on the secondary garment compliments the at least one base graphic image on the primary garment; and removing the secondary garment from over the primary garment and fitting the third garment over the primary garment to produce a second multi-layered combinatory image that is distinct to the first multi-layered combinatory image, and wherein the at least one enhancement graphic image on the third garment compliments the at least one base graphic image on the primary garment.

2. A method for creating enhanced ornamental images on a multi-layered clothing combination comprising the steps of:

providing a primary garment having at least one base graphic image thereon;

providing a secondary garment that is independent of and detached from the primary garment, and the secondary garment having at least one enhancement graphic image thereon and being adapted to fit over the primary garment, and the secondary garment being formed of a material that is structured and disposed to allow an image to be visible through the material;

providing a third garment that is independent of and detached from the primary garment and the secondary garment, and the third garment having at least one enhancement graphic image thereon that is different than the at least one enhancement graphic image on the secondary garment, and the third garment being adapted to fit over the primary garment and the secondary garment and the third garment being formed of a material that is structured and disposed to allow an image to be visible through the material;

fitting the secondary garment over the primary garment to produce a first multi-layered combinatory image, wherein the at least one enhancement graphic image on the secondary garment compliments the at least one base graphic image on the primary garment; and fitting the third garment over the secondary garment to produce a second multi-layered combinatory image that is distinct to the first multi-layered combinatory image, and wherein the at least one enhancement graphic images on the secondary garment and the third garment compliment the at least one base graphic image on the primary garment.

* * * * *